US008241049B2

(12) United States Patent
Sun

(10) Patent No.: US 8,241,049 B2
(45) Date of Patent: Aug. 14, 2012

(54) ADAPTER APPARATUS

(75) Inventor: Zheng-Heng Sun, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/965,827

(22) Filed: Dec. 11, 2010

(65) Prior Publication Data

US 2012/0135616 A1 May 31, 2012

(30) Foreign Application Priority Data

Nov. 29, 2010 (CN) ..... 2010 1 0563896

(51) Int. Cl.
*H01R 13/60* (2006.01)

(52) U.S. Cl. ..... 439/142

(58) Field of Classification Search ..... 439/135–147, 439/638
See application file for complete search history.

(56) References Cited

U.S. PATENT DOCUMENTS 6,602,081 B1 * 8/2003 Wang ..... 439/145
* cited by examiner

*Primary Examiner* — Ross Gushi
(74) *Attorney, Agent, or Firm* — Altis Law Group, Inc.

(57) ABSTRACT

An adapter apparatus includes a main body, two conductive head portions, and two covers. The main body includes a first end and a second end opposite to the first end. The conductive head portions are electrically connected to each other, and pivotably mounted to the first and second ends, respectively, to pivot between first positions where the covers cover the corresponding head portions, and second positions where the covers are latched to the main body to expose the corresponding head portions.

9 Claims, 5 Drawing Sheets

ADAPTER APPARATUS

BACKGROUND

1. Technical Field

The present disclosure relates to adapter apparatuses, particularly to an adapter apparatus for universal serial bus (USB) connectors.

2. Description of Related Art

With advances in technology, USB connectors are more and more popularly used in computers. There are two types of USB connectors: male and female. The female connector is configured to receive the male connector. Female connectors are not configured to receive female connectors, and male connectors are not configured to receive male connectors without the use of adapters. However, because of different sizes of the male and female connectors, there is no universal adapter for both types of the connectors.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
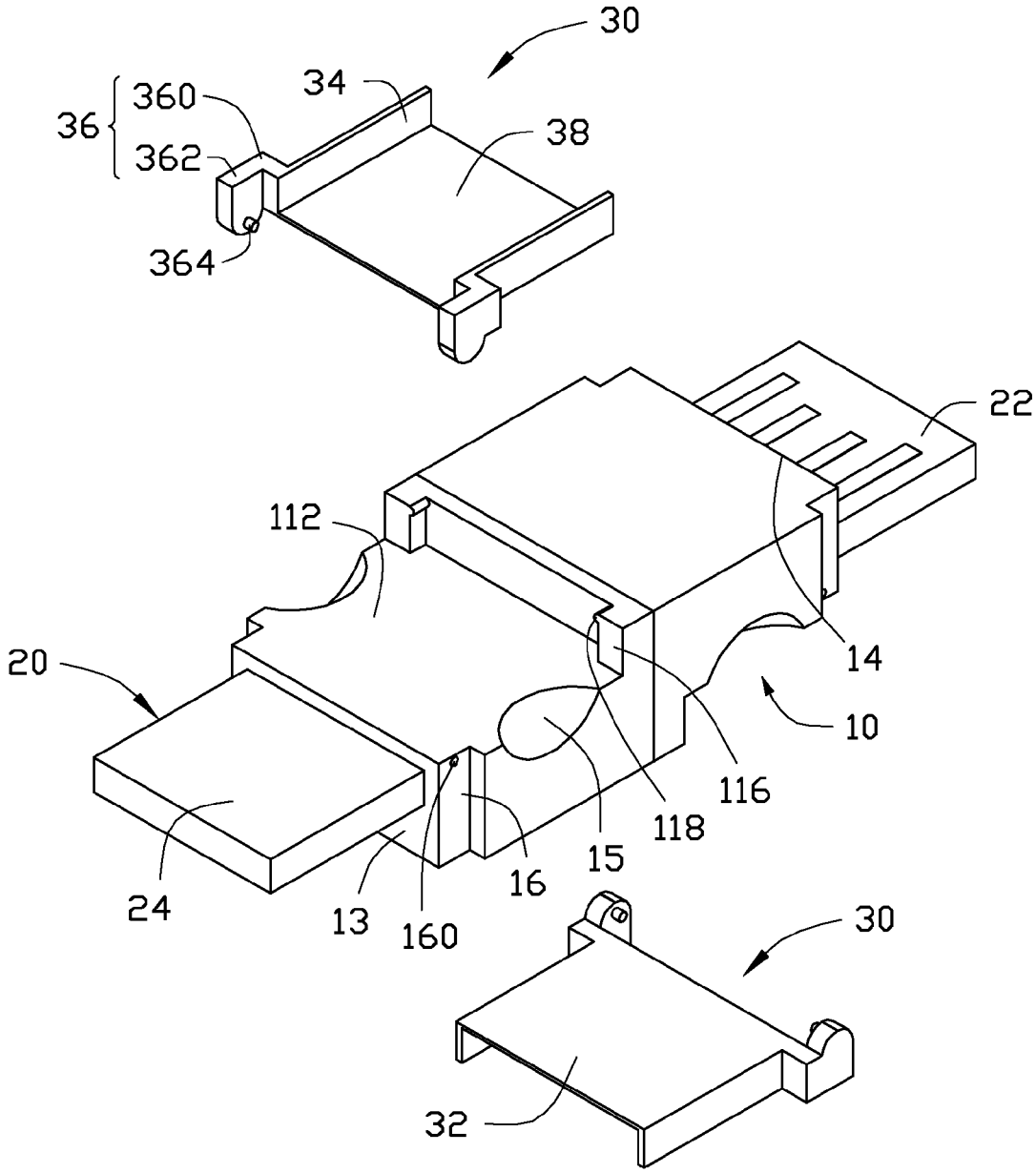
FIG. 1 is an exploded, isometric view of an exemplary embodiment of an adapter apparatus.

Referring to FIG. 1, an exemplary embodiment of an adapter apparatus includes a main body 10, two conductive head portions 20, and two covers 30.

The main body 10 includes a first end 13 and a second end 14 opposite to the first end 13. Two substantially rectangular-shaped depressed portions 112 are respectively defined in a top and a bottom of the main body 10, and respectively adjacent to the first end 13 and the second end 14. Two clamping blocks 116 extends from opposite ends of a sidewall of each depressed portion 112 opposite to the corresponding one of the first and second ends. A semicolumnar-shaped latch 118 extends from an upper portion of each clamping block 116 towards the other clamping block 116. Two substantially arc-shaped cutouts 15 are defined in opposite ends of a bottom wall of each depressed portion 112. Two avoiding cutouts 16 are defined in opposite sides of the main body 10, adjacent to each of the first and second ends. A sidewall bounding each slot 16 defines a pivot hole 160, adjacent to the corresponding depressed portion 112.

The conductive head portions 20 are positioned at the first end 13 and the second end 14, respectively, and are electrically connected to each other. Each conductive head portion 20 includes an insulated surface 24 facing the same direction with the corresponding depressed portion 112 at the same end of the main body 10, and a conductive surface 22 opposite to the insulated surface 24. A plurality of conductive pins is attached to the conductive surface 22.

Each cover 30 includes a base plate 32, two side plates 34 substantially perpendicularly extending from opposite sides of the base plate 32, and two pivot portions 36 extending from corresponding ends of the side plates 34. The base plate 32 and side plates 34 cooperatively bound a receiving space 38 for receiving the corresponding conductive head portion 20. Each pivot portion 36 is substantially L-shaped and includes a connection plate 360 substantially perpendicularly extending from the end of the corresponding side plate 34 away from the other side plate 34, and a pivot plate 362 substantially perpendicularly extending from a distal end of the connection plate 360 and parallel to the side plate 34. A pivot pin 364 extends from each pivot plate 362 towards the other pivot plate 362.

Figure 2:
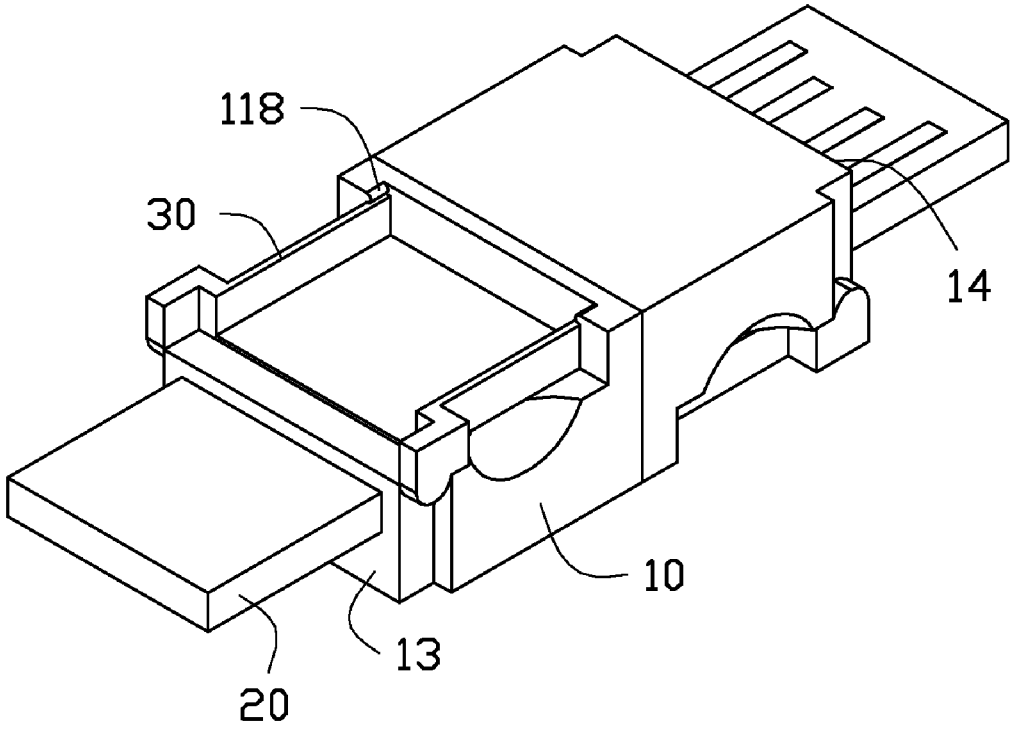
FIG. 2 is an assembled, isometric view of the adapter apparatus of FIG. 1.

Referring to FIG. 2, in assembly, the pivot pins 364 of the two covers 30 are engaged in the corresponding pivot holes 160 of the first and second ends 13 and 14, to rotatably mount the covers 30 to the first and second ends 13 and 14, respectively. Each cover 30 is rotated relative to the main body 10 to be accommodated in the corresponding depressed portion 112, with the clamping blocks 116 sandwiching the cover 30 and the latches 118 resisting against the base plate 32 towards the bottom wall of the depressed portion 112. Thereby, the covers 30 can be tightly fastened to the main body 10.

Figure 4:
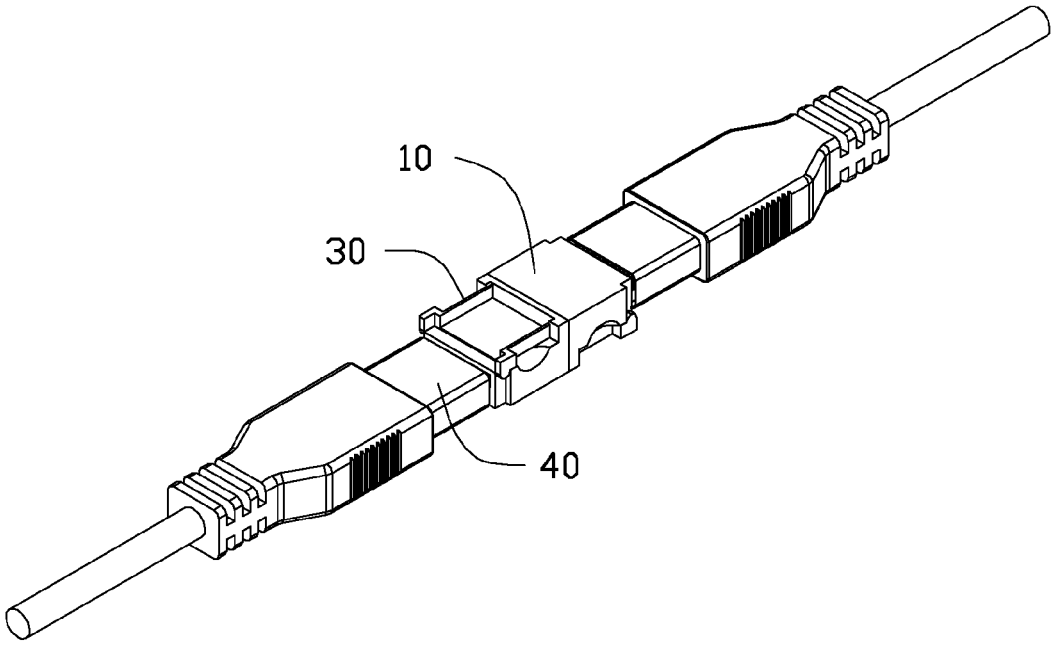
FIG. 4 is a use state of the adapter apparatus of FIG. 2.

Referring to FIG. 4, in use, the conductive head portions 20 are respectively directly plugged into two male connectors 40 to electrically connect the two male connectors 40.

Figure 3:
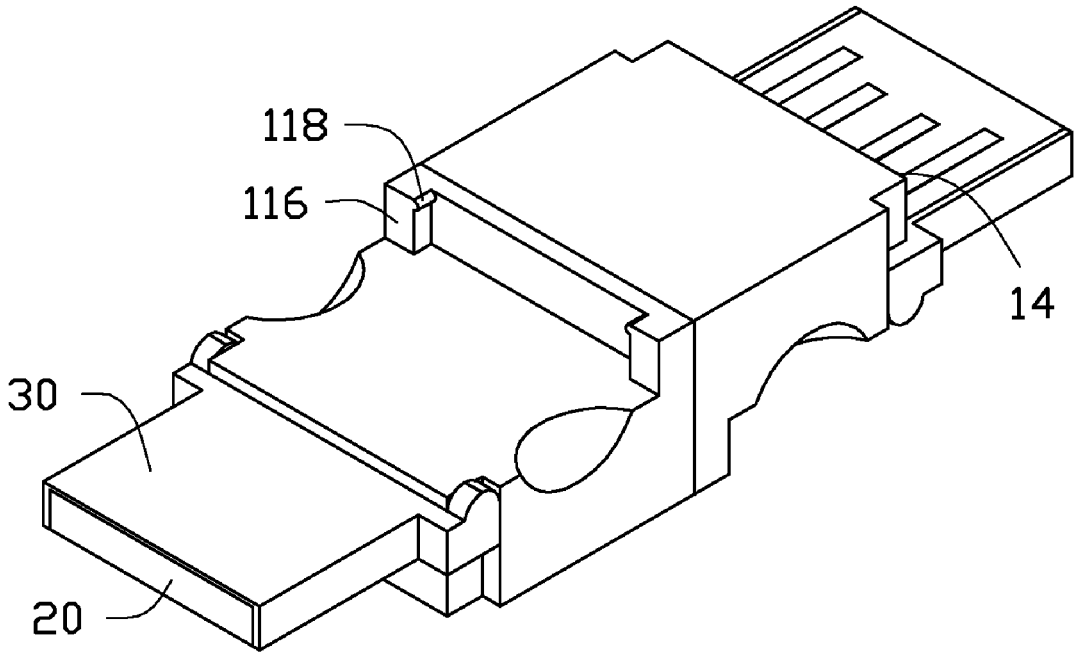
FIG. 3 is another state of the adapter apparatus of FIG. 2.
Figure 5:
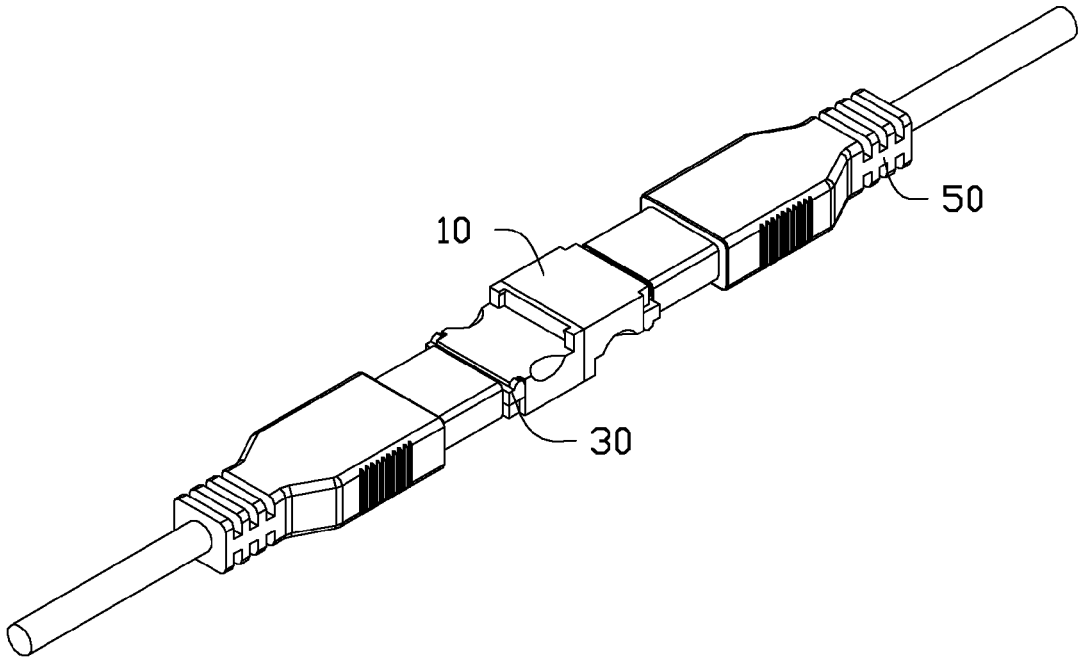
FIG. 5 is a use state of the adapter apparatus of FIG. 3.

Referring to FIGS. 3 and 5, when the adapter apparatus is used to electrically connect two female connectors 50, the side plates 34 of each cover 30 are squeezed to be deformed, thereby releasing from the corresponding latches 118. Each cover 30 is rotated to cover the insulated surface 24 of the corresponding conductive head portion 20. The conductive head portions 20 with the corresponding covers 30 are plugged into the two female connectors 50, respectively, electrically connecting the two female connectors 50.

In this embodiment, the avoiding cutouts 16 can receive the pivot portions 36 of the covers 30, which is convenient for when the covers 30 rotate relative to the main body 10. The latches 118 are semicolumnar-shaped, which is convenient to let two side plates 34 of each cover 30 to enter between two corresponding latches 118. The cutouts 15 provide space for fingers to conveniently squeeze the side plates 34 of each cover 30.

It is to be understood, however, that even though numerous characteristics and advantages of the embodiments have been set forth in the foregoing description, together with details of the structure and function of the embodiments, the present disclosure is illustrative only, and changes may be made in details, especially in matters of shape, size, and arrangement of parts within the principles of the embodiments to the full extent indicated by the broad general meaning of the terms in which the appended claims are expressed.

The invention claimed is:

1. An adapter apparatus comprising:

a main body comprising a first end and a second end opposite to the first end;

two conductive head portions electrically connected to each other and mounted to and protruding outwards from the first end and second end, respectively; and two covers rotatably mounted to the first end and second end respectively, to be rotated between first positions where the covers cover the corresponding head portions and second positions where the covers are latched to the main body to expose the corresponding head portions.

2. The adapter apparatus of claim 1, wherein a top and a bottom of the main body each define a depressed portion, adjacent to the first and second ends respectively, two clamping blocks protrude from opposite ends of a sidewall of each depressed portion toward a corresponding one of the first and second ends, to sandwich the corresponding cover in response to the cover moving to the second position to be accommodated in the corresponding depressed portion.

3. The adapter apparatus of claim 2, wherein a latch extends from each clamping block towards the other clamping block of each depressed portion, to resist against the cover toward a bottom wall of the depressed portion in response to the cover moving to the second position.

4. The adapter apparatus of claim 3, wherein each cover comprises a base plate, two side plates substantially perpendicularly extending from opposite sides of the base plate, the clamping blocks resist against lateral surfaces of the corresponding side plates, and the latches resist against tops of the corresponding side plates opposite to the bottom wall of the depressed portion.

5. The adapter apparatus of claim 4, wherein the cover further comprises two pivot portions extending from corresponding ends of the side plates, a pivot pin extends from each pivot portion, and opposite sides of the first end and second end of the main body each define a pivot hole to pivotably receive the pivot pin of the corresponding cover, thereby pivotably mounting the cover to the main body, and the cover pivots between the first and second positions.

6. The adapter apparatus of claim 5, wherein each pivot portion is substantially L-shaped and comprises a connection plate substantially perpendicularly extends out from the end of the corresponding side plate and a pivot plate substantially perpendicularly extending from a distal end of the connection plate, the pivot pin extends from the pivot plate.

7. The adapter apparatus of claim 6, wherein two avoiding cutouts are defined in opposite sides of each end of the main body, the pivot hole is defined in the corresponding avoiding portion, wherein the pivot portions of the covers are accommodated in the corresponding avoiding cutouts in response to the cover pivoting to the first position.

8. The adapter apparatus of claim 2, wherein each cover comprises a base plate, two side plates substantially perpendicularly extending from opposite sides of the base plate, the clamping blocks resist against lateral surfaces of the corresponding side plates.

9. The adapter apparatus of claim 1, wherein each conductive head portion comprises a conductive surface and an insulated surface opposite to the conductive surface, wherein when the corresponding cover moves to the first position, the cover covers the insulated surface.

* * * * *